US009905345B2

(12) United States Patent
Sassaman et al.

(10) Patent No.: US 9,905,345 B2
(45) Date of Patent: Feb. 27, 2018

(54) MAGNET ELECTROPLATING

(71) Applicant: Apple Inc., Cupertino, CA (US)

(72) Inventors: Katie L. Sassaman, San Jose, CA (US); Wai Man Raymund Kwok, Hong Kong (HK); Amy Qian, San Jose, CA (US); Andrea L. Blakemore, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/085,931

(22) Filed: Mar. 30, 2016

(65) Prior Publication Data

US 2017/0084372 A1 Mar. 23, 2017

Related U.S. Application Data

(60) Provisional application No. 62/221,271, filed on Sep. 21, 2015.

(51) Int. Cl.

| | |
|---|---|
| ***H01F 7/02*** | (2006.01) |
| ***H01F 41/02*** | (2006.01) |
| ***C23C 18/38*** | (2006.01) |
| ***C23C 18/48*** | (2006.01) |
| ***C23C 18/42*** | (2006.01) |
| ***C23C 18/31*** | (2006.01) |
| ***C23C 18/16*** | (2006.01) |

(52) U.S. Cl.

CPC ..... *H01F 7/021* (2013.01); *C23C 18/1635* (2013.01); *C23C 18/1651* (2013.01); *C23C 18/1689* (2013.01); *C23C 18/31* (2013.01); *C23C 18/38* (2013.01); *C23C 18/42* (2013.01); *C23C 18/48* (2013.01); *H01F 41/0253* (2013.01); *Y10T 428/1291* (2015.01); *Y10T 428/12861* (2015.01); *Y10T 428/12882* (2015.01); *Y10T 428/24942* (2015.01)

(58) Field of Classification Search

None

See application file for complete search history.

(56) References Cited

U.S. PATENT DOCUMENTS 4,959,273 A * 9/1990 Hamamura ..... H01F 1/0577 419/7
5,154,978 A * 10/1992 Nakayama ..... B05D 1/60 427/129

(Continued)

FOREIGN PATENT DOCUMENTS

CN 101724830 B 2/2012
EP 361308 B1 4/1993

(Continued)

*Primary Examiner* — Kevin M Bernatz

(74) *Attorney, Agent, or Firm* — Downey Brand LLP

(57) ABSTRACT

Coatings for magnetic materials, such as rare earth magnets, are described. The coatings are designed to reduce or prevent the release of one or both of nickel and cobalt from the coatings or from the underlying magnetic material. The coatings are designed to resist corrosion and release of nickel and cobalt when exposed to moist conditions. The coatings are also designed to be robust enough to withstand damage due to scratch forces. In some embodiments, the coatings include multiple layers of one or of metal and non-metal materials. The coated magnets are well suited for use in the manufacture of wearable consumer products.

20 Claims, 12 Drawing Sheets

(56) References Cited

U.S. PATENT DOCUMENTS

| | | | | |
|---|---|---|---|---|
| 5,360,674 | A * | 11/1994 | Kawai | H01F 1/0577 427/127 |
| 5,595,608 | A | 1/1997 | Takebuchi et al. | |
| 6,174,609 | B1 | 1/2001 | Katsumi et al. | |
| 6,365,011 | B1 * | 4/2002 | Yumshtyk | C23C 14/046 204/192.12 |
| 6,821,357 | B2 | 11/2004 | Makita et al. | |
| 7,207,091 | B2 | 4/2007 | Dunaye | |
| 7,696,662 | B2 | 4/2010 | Komuro et al. | |
| 7,785,460 | B2 | 8/2010 | Niinae | |
| 8,273,466 | B1 * | 9/2012 | Saraiya | C23C 18/1651 428/621 |
| 9,287,027 | B2 * | 3/2016 | Miyao | C22C 9/00 |
| 9,446,565 | B2 * | 9/2016 | Hughes | B32B 15/015 |
| 2003/0052013 | A1 * | 3/2003 | Ando | C25D 3/38 205/296 |
| 2004/0137162 | A1 | 7/2004 | Kikui et al. | |
| 2007/0284255 | A1 * | 12/2007 | Gorokhovsky | C23C 14/024 205/89 |
| 2009/0035603 | A1 | 2/2009 | Niinae | |
| 2011/0037549 | A1 | 2/2011 | Miyao et al. | |
| 2014/0224664 | A1 | 8/2014 | Kamachi | |
| 2015/0161919 | A1 * | 6/2015 | Lim | G09F 3/10 428/623 |
| 2015/0173468 | A1 | 6/2015 | Stevenson | |
| 2016/0032447 | A1 * | 2/2016 | Chiang | C23C 14/352 204/192.15 |
| 2016/0086754 | A1 * | 3/2016 | Shimoda | H01H 50/28 335/2 |
| 2017/0056631 | A1 * | 3/2017 | Leung | A61L 31/028 |

FOREIGN PATENT DOCUMENTS

| | | | |
|---|---|---|---|
| EP | 736884 | B1 | 11/1999 |
| JP | H04253306 | A | 9/1992 |
| JP | H04276603 | A | 10/1992 |
| JP | H0582320 | A | 4/1993 |
| JP | 3142172 | B2 | 3/2001 |
| JP | 2002332592 | A | 11/2002 |
| JP | 2003249405 | A | 9/2003 |
| JP | 2004111516 | A | 4/2004 |
| JP | 2008147642 | A | 6/2008 |
| WO | 1999043862 | A1 | 9/1999 |
| WO | 2007091602 | A1 | 8/2007 |
| WO | 2013047340 | A1 | 3/2015 |

* cited by examiner

MAGNET ELECTROPLATING

CROSS REFERENCE TO RELATED APPLICATION

This application claims the benefit of priority under 35 U.S.C § 119(e) to U.S. Provisional Application No. 62/221,271, entitled "MAGNETIC ELECTROPLATING," filed on Sep. 21, 2015, which is incorporated by reference herein in its entirety.

FIELD

The described embodiments relate generally to coatings for magnets and methods for forming the same. More particularly, the present embodiments relate to coatings that reduce or prevent the release of nickel or cobalt from an exterior surface of the coating.

BACKGROUND

Rare earth magnets are strong magnets, and are therefore used extensively in many products. Some of the characteristics of rare earth magnets, however, include a propensity for corrosion and brittleness. Therefore, many manufacturers cover surfaces of rare earth magnets with protective coatings. The protective coatings often include nickel due to nickel's high corrosion resistance. Typically, the magnets are encased within layers of nickel and copper.

It has been observed, however, that these nickel-containing coatings can release certain amounts of nickel when exposed to moisture. This can be a problem in consumer products that have magnets that can come into contact with a person's skin since nickel can elicit allergic skin reactions in some people. Thus, some of these protective coatings should be avoided when coating magnets used as fastening elements in wearable products such as bracelets, necklaces, watches, brooches and other jewelry, where a user's skin may be in contact with the fastening elements for prolonged time periods. What are needed therefore are coatings for magnets that reduce or prevent the release of nickel or other skin irritants to levels appropriate for wearable products.

SUMMARY

This paper describes various embodiments that relate to coatings for magnets. In particular embodiments, the coatings have multiple layers of material that cooperate to provide a durable and corrosion resistant coating that reduces or prevents the release of nickel or other potentially skin irritating agents from the coating or underlying magnet.

According to one embodiment, a multilayered coating for a magnet is described. The multilayered coating includes a first layer disposed on the magnet. A portion of the first layer is diffused within intergranular cracks of the magnet. The multilayered coating also includes a second layer disposed on the first layer. The second layer is characterized as having a first ductility. The multilayered coating further includes a third layer disposed on the second layer. The third layer is characterized as having a second ductility less than the first ductility. The multilayered coating additionally includes a fourth layer disposed on the third layer. The fourth layer has an exposed surface corresponding to an exterior surface of the multilayered coating. The fourth layer is substantially free of cobalt and nickel.

According to a further embodiment, a method of forming a multilayered coating on a magnet is described. The method includes plating a first layer on a surface of the magnet such that a portion of the first layer diffuses within intergranular cracks of the magnet. The method also includes plating a second layer on the first layer. The second layer is characterized as having a first ductility. The method further includes plating a third layer on the second layer. The third layer is characterized as having a second ductility less than the first ductility. The method additionally includes depositing a fourth layer on the third layer such that the fourth layer has an exposed surface corresponding to an exterior surface of the multilayered coating. The fourth layer is substantially free of nickel and cobalt.

According to an additional embodiment, a multilayered coating for a magnet is described. The multilayered coating includes a first layer disposed on a surface of the magnet. The first layer includes copper. The multilayered coating also includes a second layer disposed on the first layer. The second layer includes tin and copper. The multilayered coating further includes a third layer disposed on the second layer. The third layer corresponds to an outer layer of the multilayered coating. The third layer includes at least one of gold, rhodium, ruthenium or palladium.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
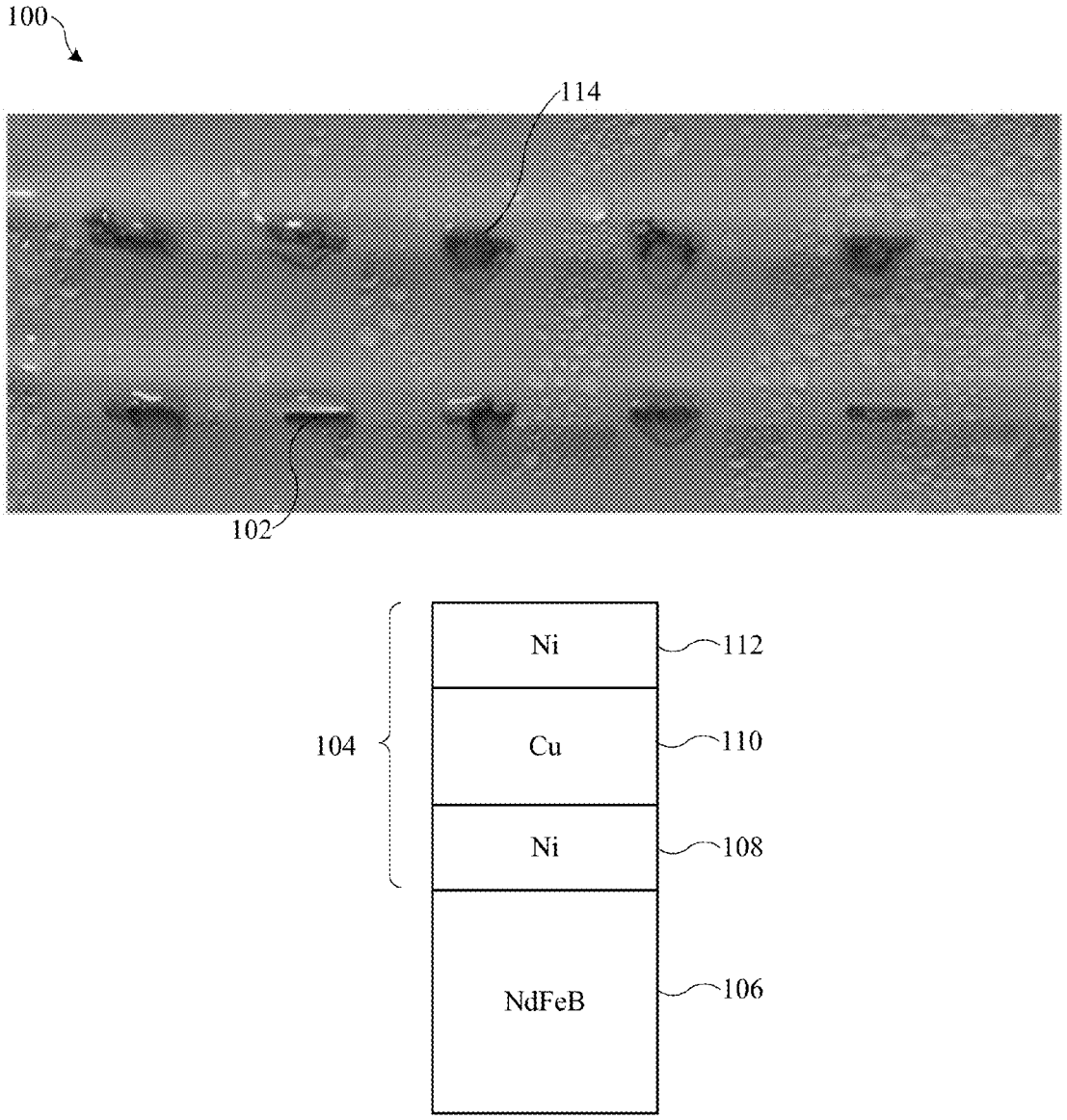
FIG. 1 (Prior Art)
FIG. 1 shows a photograph and a multilayered stack up for a convention magnet coating.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to magnets and coatings for magnets, such as rare earth magnets. The coatings are designed to reduce or prevent the release of nickel and/or cobalt from the coating and/or magnet, thereby preventing allergic skin reactions to nickel/cobalt if the magnets come in contact with skin. The coated magnets described herein are useful in the manufacture of consumer products that come into contact with a person's skin, such as wearable electronic devices like watchbands.

In some embodiments the coatings are multilayered and have different layers of material that serve different functions. In some embodiments, the coatings are free from nickel and/or cobalt. In other embodiments, the coatings include one or more underlying layers of nickel that are covered by one or more protective layers that prevent nickel from leaching from the coating. In some embodiments, any nickel used is in a state that is non-conducive to release from the coating. The multiple layers can be deposited using any suitable technique, including different electroplating methods such as electroless plating.

The coatings can be tested for their ability to prevent exposure of the underlying magnet, thereby preventing corrosion of the magnet and an associated release of cobalt from the magnet. The coatings can be also tested for their robustness and ability to resist scratching such that any underlying nickel-containing layers are not exposed or minimally exposed. The coatings can be also tested for their corrosion and nickel/cobalt release resistance when exposed to moisture, such as by salt spray testing that can simulate sweaty conditions from a user's skin.

The magnetic coatings described herein are well suited for implementation with consumer electronic products. For example, the magnetic coatings can be used in the design and manufacture of portable electronic devices such as mobile phones, wearable electronic devices (e.g., smart watches), media players, tablet and laptop computers, electronic device accessories (e.g., covers and cases)—as well as larger electronic devices such as desktop and workstation computers, such as those manufactured by Apple Inc., based in Cupertino, Calif.

These and other embodiments are discussed below with reference to FIGS. 1-12. However, those skilled in the art will readily appreciate that the detailed description given herein with respect to these Figures is for explanatory purposes only and should not be construed as limiting.

Rare earth magnets, such as neodymium magnets, can generate strong magnetic fields and are therefore used in many consumer products such as computer hard drives, motors, speakers and toys. Often, the rare earth magnets are coated with a protective coating to protect the rare earth magnet from exposure to moisture, which can quickly corrode rare earth magnets. One of the most common coatings is nickel since nickel has high corrosion resistance and can be plated onto rare earth magnets.

It has been found, however, that standard nickel containing coatings may not provide adequate protection against corrosion under certain conditions. This is illustrated by FIG. 1, which shows a photograph 100 of magnets 102 coated with a standard nickel containing multilayered stack up 104 after a salt mist test (also referred to as a salt spray test). Stack up 104, which represents the layers of the multilayered coating on neodymium/iron/boron magnet 106, includes first nickel layer 108, copper layer 110, and second nickel layer 112. Typically, each layer of stack up 104 is successively plated onto each other. In the sample shown in FIG. 1, first nickel layer 108 has a thickness of about 2 micrometers, copper layer 110 has a thickness of about 3 micrometers, and second nickel layer 112 has a thickness of about 2 micrometers.

Photograph 100 shows significant evidence of corrosion after magnets 102 were sprayed with salt water and allowed to stand in the salt water for eight hours. In particular, dark areas 114 around magnets 102 correspond to corrosion products related to oxidized magnet material. This testing indicates that a standard nickel and copper stack up 104 may not be robust enough to protect neodymium type magnet 106 from corrosion under moisture conditions that a wearable product may be exposed. For example, a watch band will likely be exposed to sweat from a person's wrist for prolong time periods.

Furthermore, some people experience contact dermatitis when their skin comes in contact with nickel. Thus, magnets in products designed for direct and prolonged contact with skin, such as jewelry and watches, should not release nickel in sufficient amounts to cause allergic reactions. To quantify acceptable amounts of nickel, many manufacturers use the European Union's EN 1811 and EN 12472 guidelines and testing methods for quantifying acceptable levels of nickel release from products in order to ensure proper consumer protection. EN 1811 sets forth guidelines and procedures as to acceptable amounts of nickel release per area, per time period for a post assembly product. For articles that are intended to come in come into direct and prolonged contact with skin, some manufactures aim for compliance with No. 27 Annex XVII of Regulation (EC) No 1907/2006 of the Registration, Evaluation, Authorization and Restriction of Chemicals (REACH) regulations. EN 12472 sets forth guidelines and procedures as to an abrasion tests that simulate two years of normal use for items with nickel below an outer surface layer.

An additional consideration relates to the release of cobalt. Cobalt, which is generally used in rare earth magnet compositions, can also elicit allergic skin reactions. Thus, any breach of a coating on a rare earth magnet, such as evidenced by corrosion of the magnet, could also result in release of cobalt, which could also result in skin reactions.

One way of solving the nickel leaching problems is by avoiding the use of nickel as a magnet coating. Thus, according to some embodiments, rare earth magnets are coated with a polymer layer, such as an epoxy layer. In one embodiment, the epoxy layer was applied to a thickness of about 6 to 8 micrometers. In another embodiment, the epoxy layer was applied to a thickness of more than about 30 micrometers. Although these epoxy coatings eliminate the nickel release problem, it has been found that epoxy by itself generally does not provide adequate coverage and corrosion protection of the underlying magnet. For example, some epoxy coated magnet samples have shown evidence of magnet corrosion after an eight hour salt mist test, such as described above with reference to FIG. 1. Once again, this corrosion not only indicates inadequate protection of the rare earth magnet, but also an indication that cobalt is likely also released from the rare earth magnet.

Figure 2:
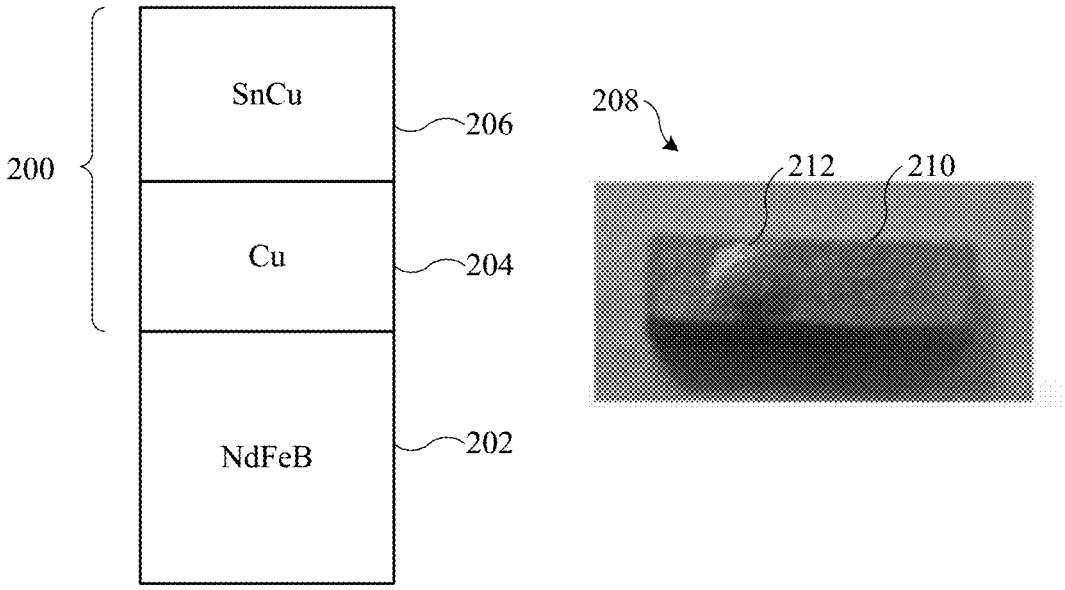
FIG. 2 shows a photograph and multilayered stack up for a magnet coating that does not include nickel.

In some embodiments, the magnets are coated with a multilayered stack up of metals other than nickel. FIG. 2 shows one such stack up 200 covering magnet 202. Stack up 200 includes copper layer 204 and tin and copper layer 206. In a particular embodiment, copper layer 204 has a thickness of about 7 micrometers, and tin and copper layer 206 has a thickness of about 8 micrometers. Since stack up 200 does not include nickel, there is no nickel release problem. However, a number of samples having the composition of stack up 200 failed the eight hour salt mist test, as described above. In addition, a number of these samples showed evidence of delamination or blistering of stack up 200 after a thermal shock test. Photograph 208 shows magnet 210 having a coating of stack up 200 after a thermal shock test where magnet 210 was heated to 250 degrees Celsius, followed by immersion in water of room temperature. As shown, the thermal shock testing resulting in blister 212 being formed, which is likely due to expansion of air or solution trapped between stack up 200 and magnet 202 during an annealing process. Blister 212 corresponds to a portion of stack up 200 that is no longer adhered to magnet 202, and will eventually cause peeling of stack up 200 away from magnet 202.

Thus, it is a goal of embodiments presented herein to provide a coating that achieves good durability and corrosion protection of an underlying magnet (e.g., as evidenced by salt mist and/or thermal shock testing) and that also releases nickel below predetermined amounts (e.g., as dictated by EN 1811 and EN 12472 testing methods).

Figure 3:
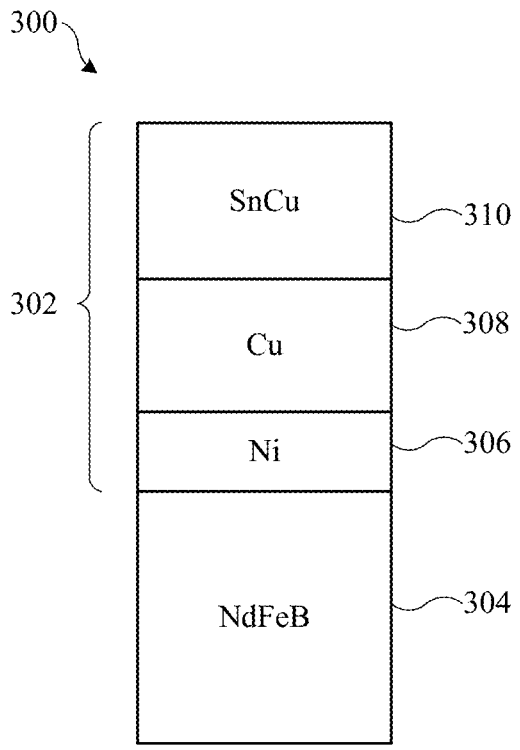
FIG. 3 shows a multilayered stack up for a magnet coating that includes an initial layer of nickel.

Improved structural integrity and corrosion resistance was found when nickel is used as an initial layer within a coating stack up. For example, FIG. 3 illustrates magnet structure 300 with a coating made of stack up 302 on neodymium/iron/boron magnet 304. Stack up 302 includes nickel layer 306, copper layer 308 and tin and copper layer 310. In particular embodiments, nickel layer 306 has a thickness of about 5 micrometers, copper layer 308 has a thickness of about 7 micrometers, and tin and copper layer 310 has a thickness of about 8 micrometers. Samples of magnet structure 300 were generally found to pass an eight hour salt spray test (i.e., showed or very little evidence of corrosion), pass a thermal shock test (i.e., little or no blistering after heating to 250 degrees C. then immersion in water at room temperature), and pass a nickel release test as dictated by EN 1811 and EN 12472 testing methods.

It should be noted that the thickness of tin and copper layer 310 is thicker than standard multilayered coating. For example, some multilayered coatings use a top layer having a thickness of about 2 micrometers. Having a thicker top layer (e.g., tin and copper layer 310) can ensure that nickel from nickel layer 306 does not get released from stack up 302. Thus, in some embodiments, tin and copper layer 310 has a thickness greater than about 2 micrometers, in some embodiments greater than about 5 micrometers, and in some embodiments about 8 micrometers or greater.

Figure 4A:
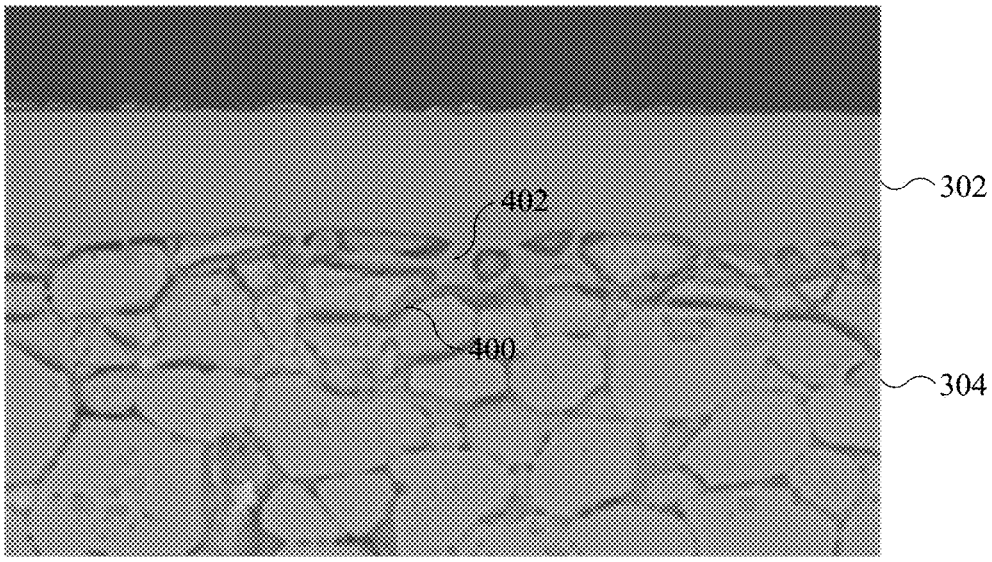
FIGS. 4A and 4B show scanning electron microscope (SEM) images of a cross-section of a magnet structure having the multilayered stack up of FIG. 3.
Figure 4B:
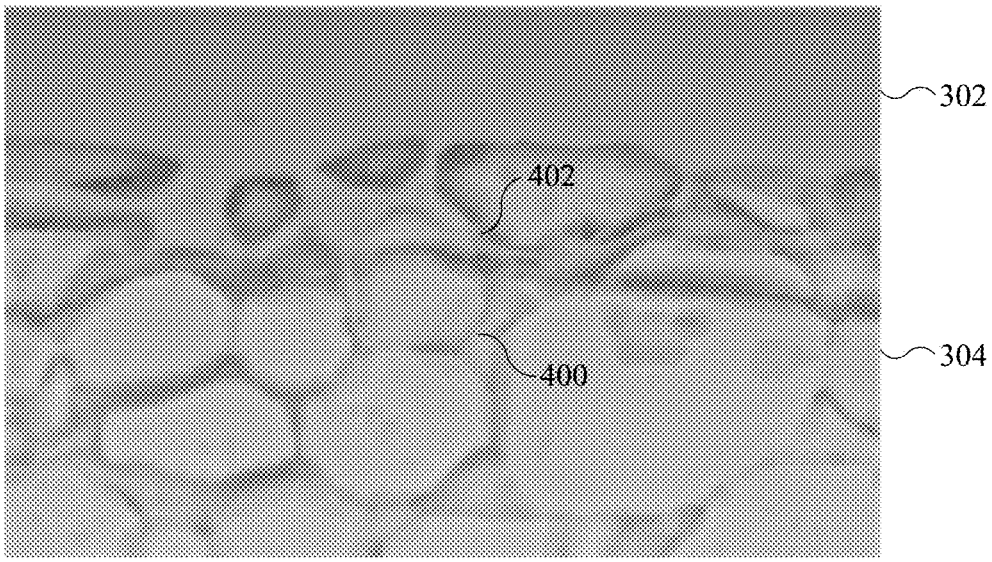

It was found that nickel from nickel layer 306 diffuses into boundaries of the neodymium/iron/boron magnet 304. To illustrate, FIGS. 4A and 4B show scanning electron microscope (SEM) images of a cross-section of a boundary portion of a sample of magnet structure 300 with stack up 302 positioned over magnet 304. FIG. 4A shows a 2,500× magnification and FIG. 4B shows a 5,000× magnification. As shown, magnet 304 includes a number of intergranular cracks 400 that are inherently formed during the manufacturing of many rare earth magnets. It has been found that some standard etching processes can exacerbate and widen intergranular cracks 400, and therefore can be avoided. The presence of intergranular cracks 400 can cause breaching of a coating if the coating is not well adhered to magnet 304 or if stresses are not sufficiently attenuated in the coating. In particular, intergranular cracks 400 can shift, thereby causing a coating that is not well adhered to magnet 304 to blister and eventually peel away from magnet 304.

The images of FIGS. 4A and 4B, however, show that nickel 402 diffuses into a surface boundary of magnet 304 and within intergranular cracks 400. This is confirmed by spectrum analysis at different points within intergranular cracks 400 near stack up 302. This infusion of nickel increases surface contact with magnet, thereby improving the adhesion of stack up 302 to magnet 304. Thus, nickel layer 306 can be referred to as an adhesion-promoting layer. The infusion of nickel 402 can also help maintain the microstructure stability of magnet 304.

Nickel layer 306 can be applied onto magnet 304 using any suitable technique. In some embodiments, nickel layer 306 is plated onto magnet 304 using standard plating techniques. In other embodiments, nickel layer 306 is electrolessly plated onto magnet 304. Electroless plating can provide a nickel layer 306 that is highly conformal and uniform in thickness. In addition, electroless plating can provide a very thin nickel layer 306, which may be beneficial in some cases.

In some cases, it has been found that plating defects in tin and copper layer 310 can compromise the integrity of tin and copper layer 310. In general, tin and copper layer 310 is relatively difficult to corrode due to the formation of layer of tin oxide (SnOx) passivation. However, when there is a pathway (e.g., via a crack, a deep scratch or a plating defect within tin and copper layer 310), sweat can reach and quickly corrode copper layer 308. When copper layer 308 becomes corroded, tin and copper layer 310 can delaminate from stack up 302 since the integrity of copper layer 308 is compromised, eventually causing corrosion of magnet 304. It should be noted, however, that a well-plated tin and copper layer 310 can act as a sacrificial anode and limit corrosion of copper 308 and nickel 306 layers if, for example, a well-plated tin and copper layer 310 is scratched or otherwise damaged.

Figure 5:
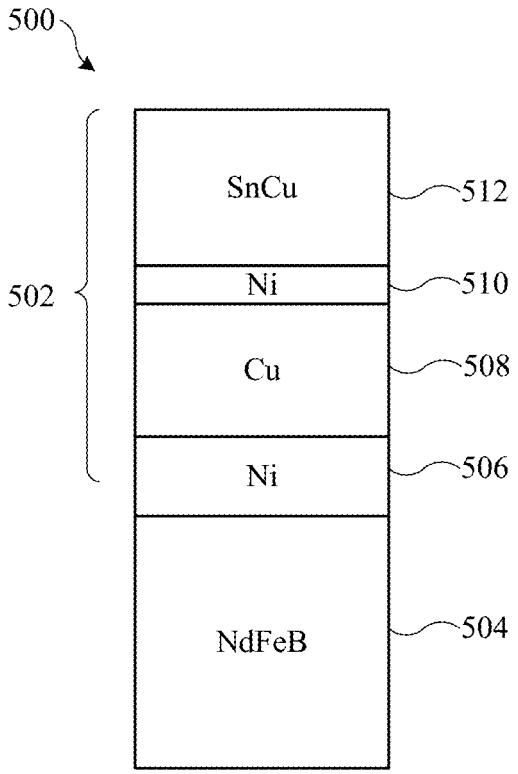
FIG. 5 shows a multilayered stack up for a magnet coating that includes two layers of nickel.

In some embodiments, an additional layer is added to the stack up 302. For example, FIG. 5 shows magnet structure 500, which includes a multilayered coating comprising stack up 502 on magnet 504. As shown, stack up 502 includes first nickel layer 506, copper layer 508, second nickel layer 510 and tin and copper layer 512. As with the magnet structure 300 described above, first nickel layer 506 can be referred to as an adhesion-promoting layer since it functions to promote adhesion between stack up 502 and magnet 504, as well as maintain a structural integrity of magnet 504. In some embodiments, first nickel layer 506 has a thickness of about 6 micrometers. First nickel layer 506 can be deposited using a standard plating or an electroless plating technique. In some embodiments, good adhesion is found when first nickel layer 506 is deposited as a semi-bright nickel layer, which is substantially free of sulfur (e.g., less than about 0.005% sulfur by weight) to provide high corrosion resistance to first nickel layer 506.

Copper layer 508 is positioned over first nickel layer 506, and functions by deforming with shifting of the microstructure of magnet 504 caused by the presence of intergranular cracks described above. That is, copper has relatively high ductility and therefore can deform under tensile stresses due to the presence of intergranular cracks within magnet 504. This can help to reduce stress buildup that could cause breaching of stack up 502 and exposure of magnet 504, which can ultimately cause corrosion of magnet 504 (referred to as stress-induced corrosion). In this way, copper layer can be referred to as a ductile layer. In some embodiments, copper layer 508 has a thickness of about 5 micrometers.

Second nickel layer 510 is added to further attenuate stress-induced corrosion caused by cracks formed within magnet 504. That is, second nickel layer 510 can add an additional ductile layer to stack up 502, thereby reducing stress buildup within stack up 502. Thus, second nickel layer 510 can be referred to as a second ductile layer. In addition, nickel is slightly more corrosion resistant than copper. Therefore, having second nickel layer 510 positioned below tin and copper layer 512 and above copper layer 508 can prevent moisture from reaching copper layer 512 if tin and copper layer 512 is compromised due to plating defects or damage (e.g., by scratching). As described above, copper layer 512 can quickly corrode when exposed to moisture, which can lead to delamination of tin and copper layer 512 and eventually lead to exposure of magnet 504. In this way, second nickel layer 510 can act as a safeguard layer. In some embodiments, good performance is found when second nickel layer 510 is deposited as a semi-bright nickel layer to provide good corrosion resistance, as described above. Second nickel layer 510 can be relatively thin compared to each of tin and copper layer 512 and copper layer 508. In some embodiments, second nickel layer 510 is thinner than first nickel layer 506. In some embodiments, second nickel layer 510 has a thickness of about 3 micrometers.

Tin and copper layer 512 is positioned on second nickel layer 510 and corresponds to an exterior layer of stack up 502. Tin and copper layer 512 includes an alloy of tin and copper. In some embodiments, the weight percent of copper ranges from about 15% to about 45%. Tin and copper layer 512 functions as a top protective layer that is scratch resistant—that is resistant to removal or peeling away by scratching or gouging forces. Tin and copper layer 512 functions as a replacement for an exterior nickel layer used in conventional magnet coatings. Tin and copper layer 512 has good corrosion resistance and does not release nickel that can cause skin reactions. Note that tin and copper layer 512 is generally less corrosion resistant than second nickel layer 510 and copper layer 506. Thus, if tin and copper layer 512 is damaged (e.g., by scratch), tin and copper layer 512 could corrode instead of second nickel layer 510 or copper layer 506 (which could cause delamination and eventual exposure of magnet 504 as described above). Thus, tin and copper layer 512 can be said to act as a sacrificial anode in stack up 502.

As described above, in some instances tin and copper layer 512 can have defects related to the plating process, which can quickly dissolve the copper and cause tin and copper layer 512 to peel. However, second nickel layer 510 can prevent further corrosion within stack up 500, thereby protecting underlying copper layer 508, first nickel layer 506 and magnet 504. Tin and copper layer 512 is nominally relatively thick compared to conventional stack ups. In some embodiments, tin and copper layer 512 is nominally thicker than each of second nickel layer 510, copper layer 508 and first nickel layer 506. In some embodiments, tin and copper layer 512 has a thickness of greater than about 2 micrometers. In a particular embodiment, tin and copper layer 512 has a thickness of about 8 micrometers.

Tin and copper layer 512 can be relatively brittle after the plating process. Therefore, in some embodiments, an annealing process is used to strengthen tin and copper layer 512. The annealing process can involve heating magnetic structure 500, including magnet 504. In particular embodiments, a slow profile annealing process was used where the temperature was raised slowly over a period of time. For example, magnet structure 500 can be heated to about 50 degrees Celsius for about 30 minutes, then about 100 degrees Celsius fro about 30 minutes, then 150 degrees Celsius for about 30 minutes, then about 200 degrees Celsius for about 1 hour, then about 220 degrees Celsius for about 1 hour. In some embodiments, an additional layer of material, such as a very thin layer of gold (e.g., about 2 micrometers thick), is deposited over tin and copper layer 512 to further prevent breaching of tin and copper layer 512.

Samples of magnet structure 500 were found to consistently pass corrosion testing by salt mist testing over seven days, as well as nickel release testing as dictated by EN 1811 and EN 12472 standards. Furthermore, these samples were also found to be durable, as tested using scratch testing. To illustrate, FIGS. 6A-6F show SEM images of cross-sections of samples having magnet structure 500 after a series of different scratch tests.

Figure 6A:
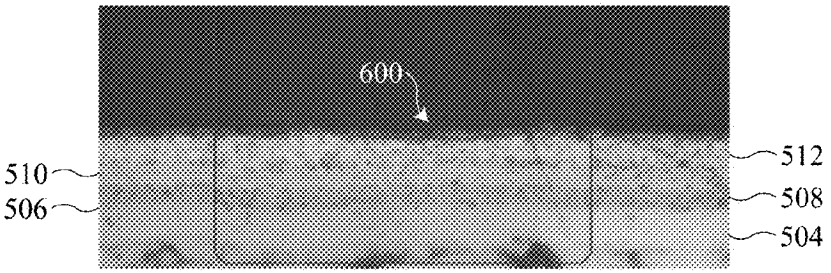
FIGS. 6A-6F show SEM images of cross-sections of samples having the multilayered stack up of FIG. 5 after a series of different scratch tests.
Figure 6B:
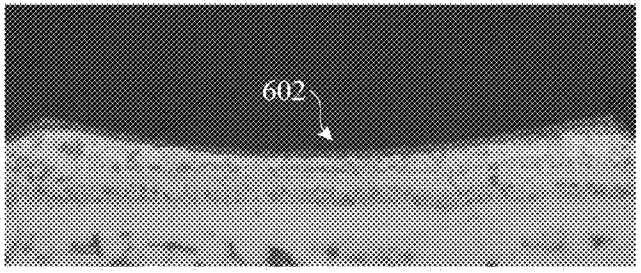
Figure 6C:
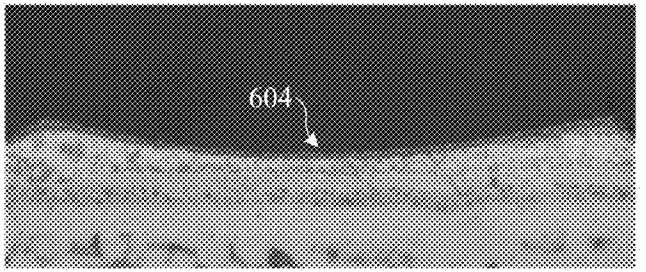
Figure 6D:
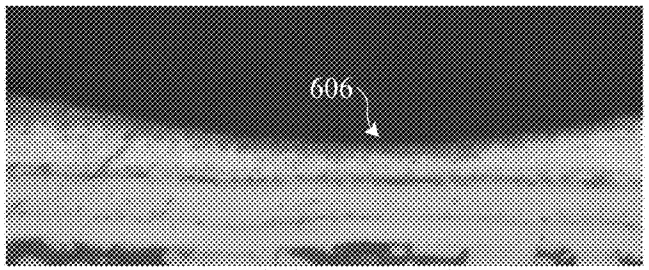
Figure 6E:
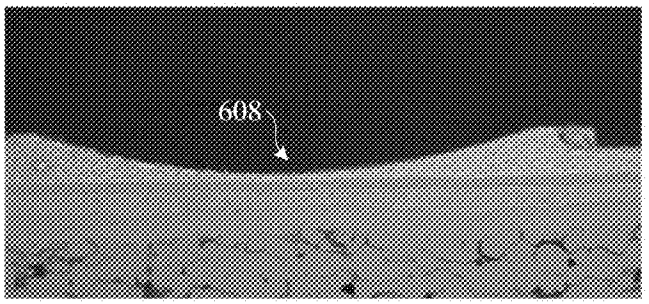
Figure 6F:
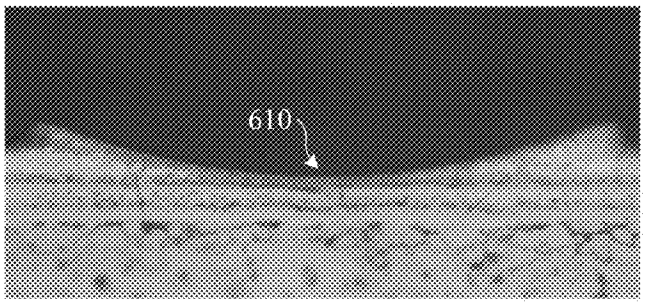

FIG. 6A shows a sample after undergoing a 1 Newton scratch test, where a tool was used to scratch the sample using 1 Newton of force. As shown, only a very small indention 602 resulted, which is barely visible to a human eye. FIGS. 6B and 6C show samples after undergoing a 5 Newton scratch test, resulting in indentations 602 and 604, respectively, that may be visible but do not reach second nickel layer 510. FIGS. 6D and 6E show samples after undergoing a 10 Newton and 15 Newton scratch test, respectively, resulting in indentations 606 and 608 that still do not reach second nickel layer 510. FIG. 6F shows a sample after undergoing a 20 Newton scratch test, resulting in indentation 610 that does reach second nickel layer 510 to some extent. Thus, magnet structure 500 can undergo scratch testing up to at least 15 Newtons of force without breaching tin and copper layer 512 to an extent that second nickel layer 510 is reached.

Figure 7:
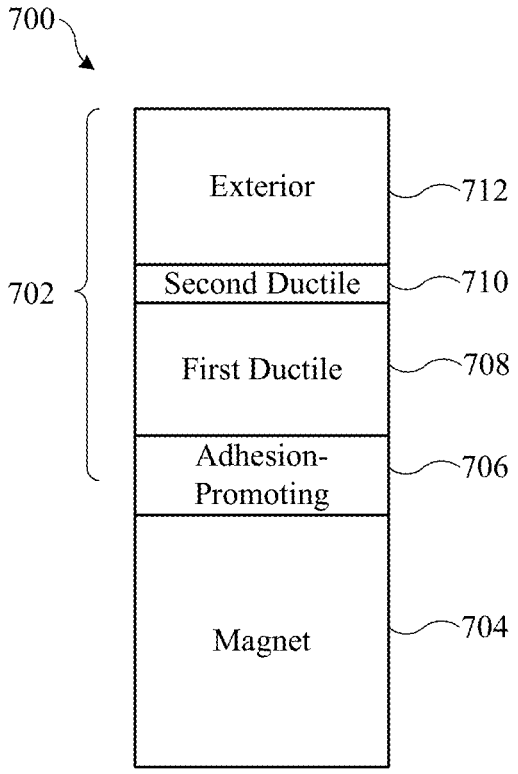
FIG. 7 shows a generic multilayered stack up for a magnet coating that is resistant to nickel and/or cobalt release.

In some embodiments, other materials are used other than nickel an adhesion-promoting layer and/or a second ductile layer. Similarly, other materials other than copper can be used as a ductile layer, and other materials other than tin and copper alloy can be used as an external layer. FIG. 7 shows a generic magnet structure 700 having stack up 702 as a coating for magnet 704. Stack up 702 includes adhesion-promoting layer 706, first ductile layer 708, second ductile layer 710 and exterior layer 712, each of which can serve different purposes to protect and prevent nickel and cobalt release and prevent corrosion of magnet 704. Magnet 704 can be any suitable type of rare earth magnet. In some embodiments, magnet 704 is a neodymium/iron/boron magnet.

Adhesion-promoting layer 706 can be made of any suitable material that provides good adhesion to magnet 704 and can provide good structural integrity to magnet 704. As described above, nickel can infuse within intergranular cracks of magnet 704, thereby creating good adhesive contact with and providing structural stability for magnet 704. Zinc has also been found to diffuse within intergranular cracks of magnet 704, and therefore can also be a good candidate for adhesion-promoting layer 706. It should be noted that in some instances a zinc adhesion-promoting layer can cause galvanic corrosion between certain metal layers, and therefore care should be taken in choosing surrounding layers of metal. In some embodiments, palladium has been found to be a good adhesion-promoting layer 706. In some embodiments, adhesion-promoting layer 706 includes one or more of nickel, electrolessly deposited nickel, zinc, electrolessly deposited zinc, palladium, electrolessly deposited palladium, or alloys thereof (e.g., palladium and nickel alloy or palladium and cobalt alloy). In some embodiments, adhesion-promoting layer 706 includes one or more sub-layers. For example, the sub-layers can include one or more zinc sub-layer, nickel sub-layer and/or palladium sub-layer, or alloys thereof.

The thickness of adhesion-promoting layer 706 can vary depending on the type of material. In a particular embodiment, adhesion-promoting layer 706 is made of nickel and has a thickness greater than about 2 micrometers. In addition, the method of deposition can vary. For example, nickel and/or zinc can be deposited using electroless plating methods in order to form a very conformal adhesion-promoting layer 706. In some embodiments, adhesion-promoting layer 706 includes copper. In some embodiments, the copper is plated using an alkaline plating solution (instead of typical acid plating solutions) in order to from a thin conformal copper adhesion-promoting layer 706. One advantage of using a non-nickel adhesion-promoting layer 706 is that there is no chance for nickel release from adhesion-promoting layer 706 in case there is a breach of stack up 702 down to adhesion-promoting layer 706.

First ductile layer 708 can be made of any suitable material that is sufficiently ductile to relieve tensile stresses encountered by stack up 702. The stress can be due to the presence of intergranular cracks within magnet 504, or due to external forces place on stack up 702 during normal use. The material of first ductile layer 708 can depend, in part, on the material of adhesion-promoting layer 706. For example, first ductile layer 708 should adhere well to adhesion-promoting layer 706. In some embodiments, first ductile layer 708 includes copper due to copper's high ductility. In particular embodiments, first ductile layer 708 includes copper and has a thickness of greater than about 2 micrometers. In some embodiments, first ductile layer 708 includes zinc. In some embodiments wherein adhesion-promoting layer 706 includes copper plated using an alkaline plating solution, first ductile layer 708 that includes copper plated using an acid plating solution was used to provide good adhesion. The thickness of first ductile layer 708 can vary. In some embodiments, first ductile layer 708 is relatively thick (e.g., thicker than adhesion-promoting layer 706) in order to impart good ductility to stack up 702.

It should be noted that in some embodiments adhesion-promoting layer 706 and first ductile layer 708 are combined as one layer. That is, a single layer made of a material having good adhesive properties with magnet 704 and good ductility can be used. In some embodiments, the single layer is a copper layer.

Second ductile layer 710 can be made of any suitable material sufficient to protect exposure of underlying magnet 704 in case exterior layer 712 is breached. In some embodiments, second ductile layer 710 includes one or more of zinc, nickel, and palladium, or alloys thereof. In some embodiments, the material of second ductile layer 710 is less ductile than the material of first ductile layer 708 (e.g., a nickel second ductile layer 710 can be less ductile than a copper first ductile layer 708). In particular embodiments, second ductile layer 710 includes nickel and has a thickness of less than about 1 micrometer. In some embodiments, second ductile layer 710 includes one or more sub-layers. For example, the sub-layers can include one or more of nickel, electrolessly deposited nickel, zinc, electrolessly deposited zinc, palladium, electrolessly deposited palladium, or alloys thereof (e.g., palladium and nickel alloy or palladium and cobalt alloy). The thickness of second ductile layer 710 can vary. In some embodiments, second ductile layer 710 is preferably relatively thin (e.g., thinner than exterior layer 712, first ductile layer 708 and/or adhesion-promoting layer 706). One advantage of using a non-nickel material is prevention of nickel release from second ductile layer 710 in case there is a breach in exterior layer 712.

Exterior layer 712 can be made of any suitable material sufficient to provide good protection to stack up 702 and magnet 704 when subjected to forces such as scratching. In addition, exterior layer 712 should be durable enough to prevent release of nickel and/or cobalt from stack up 702. In some embodiments, the thickness of exterior layer 712 should be greater than about 2 micrometers (e.g., 7 or 8 micrometers, or more). As described above tin and copper alloy is free from nickel and can provide good protection. Other candidates can include one or more layers metals such as aluminum and manganese alloy, gold and palladium alloy, palladium, rhodium, ruthenium, rhodium and ruthenium alloy, gold, zinc, and nickel. In some embodiments, exterior layer 712 includes a non-metal material such as a polymer. Some polymer candidates include epoxy and poly(p-xylylene) polymer (Parylene). In some embodiments, exterior layer 712 includes multiple metal and non-metal sub-layers. In some embodiments, exterior layer 712 includes electrolessly plated nickel since the electrolessly plated nickel can create a conformal layer that is resistant to nickel release to a certain extent. In some embodiments, the electroless nickel has a high concentration of phosphorus (high-P nickel) to create a more amorphous microstructure.

Figure 8:
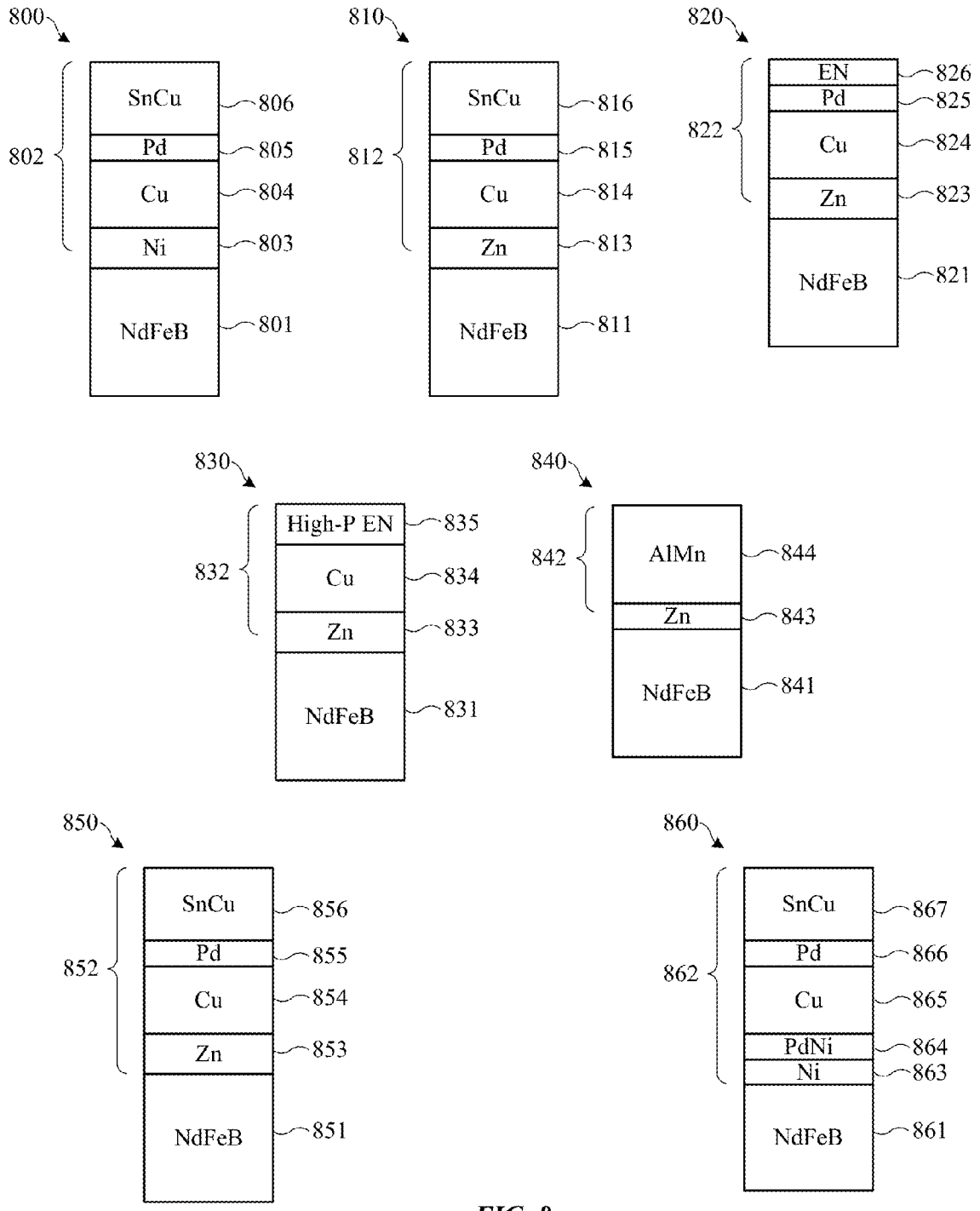
FIG. 8 shows a number of magnetic structures having multilayered coatings in accordance with some embodiments.

FIG. 8 shows a number of magnetic structures having multilayered coatings in accordance with some embodiments. Magnetic structure 800 includes stack up 802 that serves as a protective coating for magnet 801. Stack up 802 includes nickel layer 803, copper layer 804, palladium layer 805 and tin and copper layer 806. Magnetic structure 810 includes magnet 811 with stack up 812, which includes zinc layer 813, copper layer 814, palladium layer 815 and tin and copper layer 816. Magnetic structure 820 includes magnet 821 with stack up 822, which includes zinc layer 823, copper layer 824, palladium layer 825 and electrolessly plated nickel layer 826.

Magnetic structure 830 includes magnet 831 with stack up 832, which includes zinc layer 833, copper layer 834 and high phosphorus electrolessly plated nickel layer 835. Note that high-P electrolessly plated nickel layer 835 may be less susceptible to breaching can therefore may not need a second ductile layer (e.g., second nickel layer) beneath it. Magnetic structure 840 includes magnet 841 with stack up 842, which includes zinc layer 843 and aluminum and manganese layer 844. Aluminum and manganese layer 844 includes an alloy of aluminum and manganese, which can serve as an exterior layer and a ductile layer that does not need a second ductile layer (e.g., nickel layer) beneath it.

Magnetic structure 850 includes magnet 851 with stack up 852, which includes zinc layer 853, copper layer 854, palladium layer 855 and tin and copper layer 856. Magnetic structure 860 includes magnet 861 with stack up 862, which includes nickel layer 863, palladium and nickel layer 864, copper layer 865, palladium layer 866 and tin and copper layer 867. Note that nickel layer 863 and palladium and nickel layer 864 can cooperate to serve as adhesion-promoting layers (i.e., sub-layers of an adhesion-promoting layer).

Figure 9:
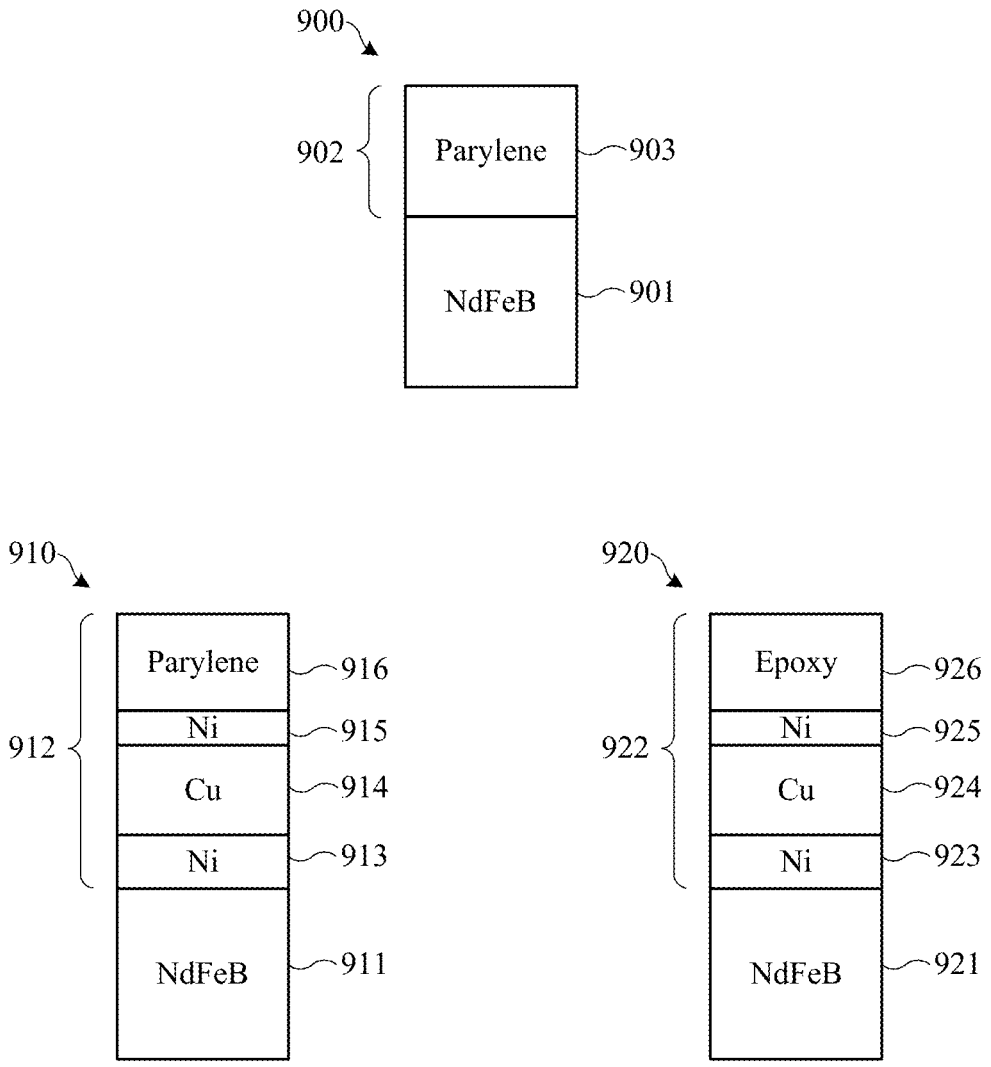
FIG. 9 shows a number of magnetic structures having multilayered coatings with non-metal exterior layers in accordance with some embodiments.

FIG. 9 shows a number of magnetic structures having multilayered coatings with a non-metal exterior layer, accordance with some embodiments. Magnet structure 900 includes magnet 901 with stack up 902, which includes a layer of Parylene (poly(p-xylylene)) 903. Parylene is very corrosion resistant and can have forms that are also scratch resistant. In some embodiments, the thickness of Parylene layer 903 ranges from about 5 to 10 micrometers. Magnet structure 910 includes magnet 911 with stack up 912, which includes nickel layer 913, copper layer 914, nickel layer 915 and Parylene (poly(p-xylylene)) layer 916. In some embodiments, the thickness of Parylene layer 916 ranges from about 5 to 10 micrometers. Magnet structure 920 includes magnet 921 with stack up 922, which includes nickel layer 923, copper layer 924, nickel layer 925 and epoxy layer 926. One of the advantages of using some polymers such as epoxy is that these materials have high abrasion resistance, and therefore protect underlying layers from damage from scratching forces. In some embodiments, the thickness of epoxy layer 926 ranges from about 5 to 8 micrometers.

Figure 10:
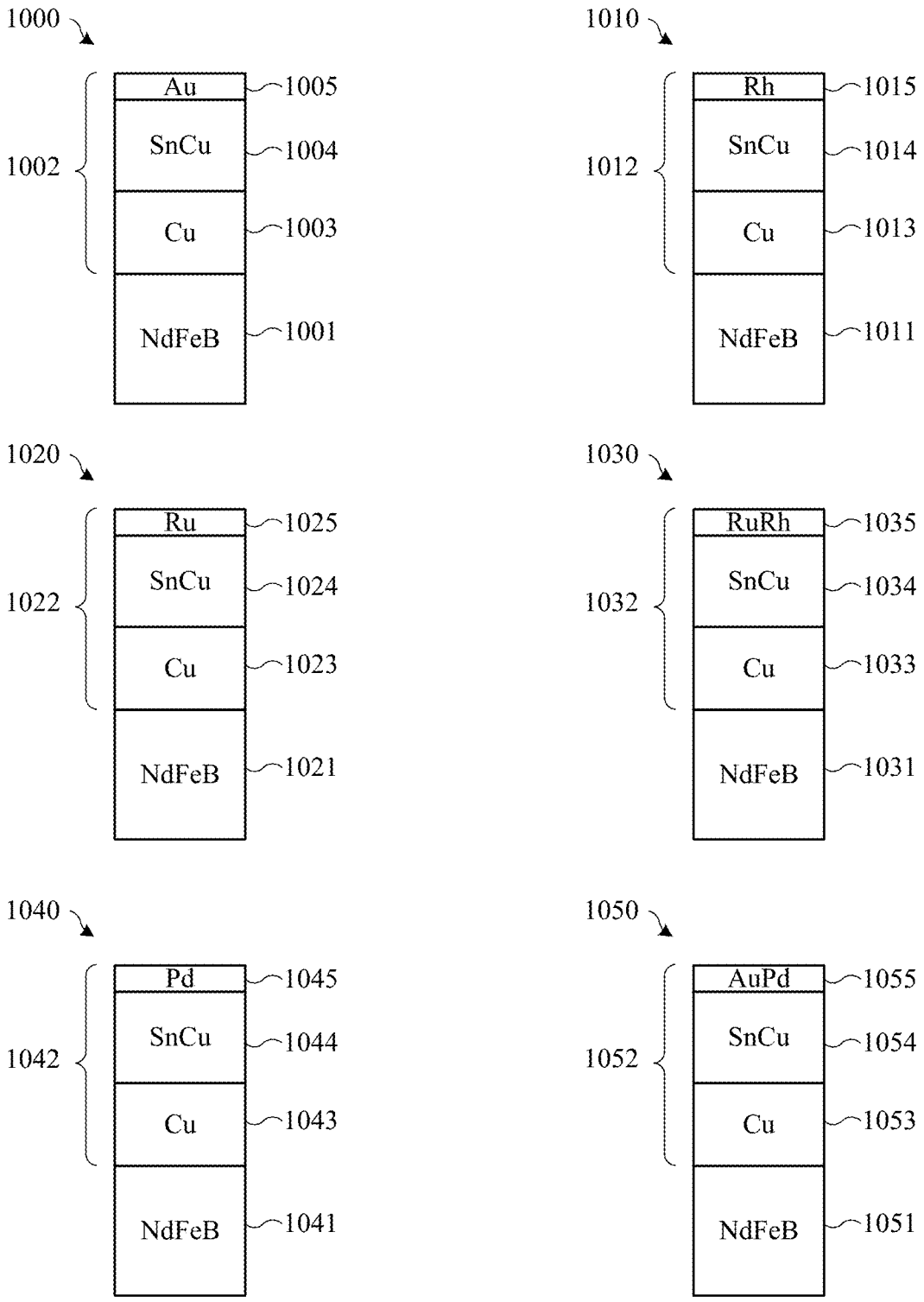
FIG. 10 shows a number of magnetic structures having multilayered coatings with integrated adhesion-promoting layer and ductile layer in accordance with some embodiments.

FIG. 10 shows a number of magnetic structures having multilayered coatings where the adhesion-promoting layer and the ductile layer are the same layer, accordance with some embodiments. Magnet structure 1000 includes magnet 1001 with stack up 1002, which includes copper layer 1003, tin and copper layer 1004 and gold layer 1005. As shown, copper layer 1003 is directly deposited onto magnet 1001 without a separate adhesion-promoting layer (e.g., nickel, zinc or palladium). In some embodiments, copper layer 1003 is deposited using an acidic plating process, while in other embodiments copper layer 1003 is deposited using an alkaline plating process. In some embodiments, copper layer 1003 includes sub-layers of copper. For example, an alkaline plating process can be used to deposit a first sub-layer of copper and an acidic plating process can be used to deposit a second sub-layer of copper. Gold layer 1005 can be used to prevent tin and copper layer 1004 from breaching, even if tin and copper layer 1004 is annealed. Gold layer 1005 can be very tin, e.g., about 2 micrometers.

Magnet structure 1010 includes magnet 1011 with stack up 1012, which includes copper layer 1013, tin and copper layer 1014 and rhodium layer 1015. Rhodium layer 1015, like gold layer 1005, can prevent tin and copper layer 1014 from forming cracks. Magnet structure 1020 includes magnet 1021 with stack up 1022, which includes copper layer 1023, tin and copper layer 1024 and ruthenium layer 1025 (to prevent tin and copper layer 1024 from breaching). Magnet structure 1030 includes magnet 1031 with stack up 1032, which includes copper layer 1033, tin and copper layer 1034 and ruthenium and rhodium layer 1035 (to prevent tin and copper layer 1034 from breaching). Ruthenium and rhodium layer 1035 is an available plating process that with about 25% by weight ruthenium can be a cost savings. Magnet structure 1040 includes magnet 1041 with stack up 1042, which includes copper layer 1043, tin and copper layer 1044 and ruthenium and rhodium layer 1045 (to prevent tin and copper layer 1044 from breaching). Magnet structure 1050 includes magnet 1051 with stack up 1052, which includes copper layer 1053, tin and copper layer 1054 and gold and palladium alloy layer 1055 (to prevent tin and copper layer 1054 from breaching). Note that gold layer 1005, rhodium layer 1015, ruthenium layer 1025, ruthenium and rhodium layer 1035, palladium layer 1045 and gold and palladium alloy layer 1055 can each be very thin (e.g., about 2 micrometers).

It should be noted that the embodiments described above with reference to FIGS. 8, 9 and 10 are exemplary and are not meant to limit other possible combinations. For example, any suitable combination of magnetic structures 800, 810, 820, 830, 840, 850, 860, 900, 910, 920, 1000, 1010, 1020, 1030 and 1040 can be used.

Figure 11:
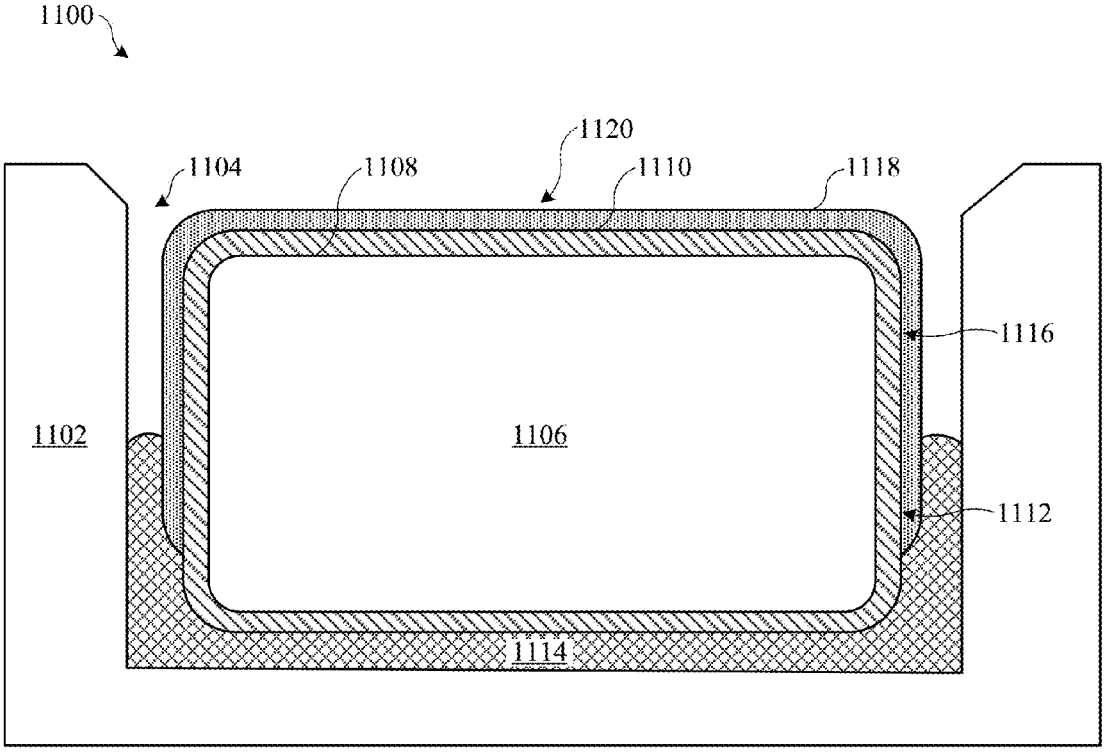
FIG. 11 shows a cross-section view of magnet assembly that includes a multilayered coated magnet.

FIG. 11 illustrates a cross-section view of magnet assembly 1100, which includes a coated magnet in accordance with some embodiments. Magnet assembly 1100 includes housing 1102, which includes cavity 1104 that is shaped and sized to accommodate coated magnet 1106. Coated magnet 1106 includes magnet 1108 that can correspond to a rare earth magnet (e.g., neodymium/iron/boron magnet), which is coated with metal coating 1110. In some embodiments, metal coating is a multilayered coating that includes multiple layers of metal, such as described above. In some embodiments, metal coating 1110 covers an entirety of magnet 1108 such that none of magnet 1108 is exposed.

A first portion 1112 of coated magnet 1106 is positioned within adhesive 1114, which adheres and secures coated magnet 1106 to housing 1102. In addition, adhesive 1114 can protect first portion 1112 of coated magnet 1106 from scratching or other forces that can damage the integrity of metal coating 1110. A second portion 1116 of coated magnet 1106 that is not positioned within adhesive 1114 can be coated with polymer coating 1118. Polymer coating 1118 can correspond to any suitable polymer material, such as some epoxy and/or Parylene (poly(p-xylylene)) polymers. Polymer coating 1118 protects second portion 1116 from scratching or other forces that can damage the integrity of metal coating 1110. In this way, metal coating 1110 is covered by either adhesive 1114 or polymer coating 1118, providing scratch protection in three dimensions.

Magnet 1108 is configured to produce a magnetic field at fastening surface 1120 so as to couple with a magnetically attractable element (e.g., another magnet or a ferrous material). In some embodiments, the magnetic field should be sufficiently strong to couple housing 1102 to a different portion of the housing, or another housing. For example, housing 1102 can be a housing for a band for a wearable electronic device, such as a smart watch. Coated magnet 1106, or an array of coated magnets, could be used to couple portions of the band together around a person's wrist. By covering magnet 1108 with metal coating 1110, adhesive 1114 and polymer coating 1118, this prevents nickel and/or cobalt from coated magnet 1106 from reaching the person's skin. The thickness of metal coating 1110 and polymer coating 1118 should be sufficiently thick to prevent release of nickel and/or cobalt (or reduce the release of nickel and/or cobalt to predetermined acceptable levels), but be thin enough for the magnetic field at fastening surface 1120 to allow adequate fastening with the corresponding magnetically attractable material.

Figure 12:
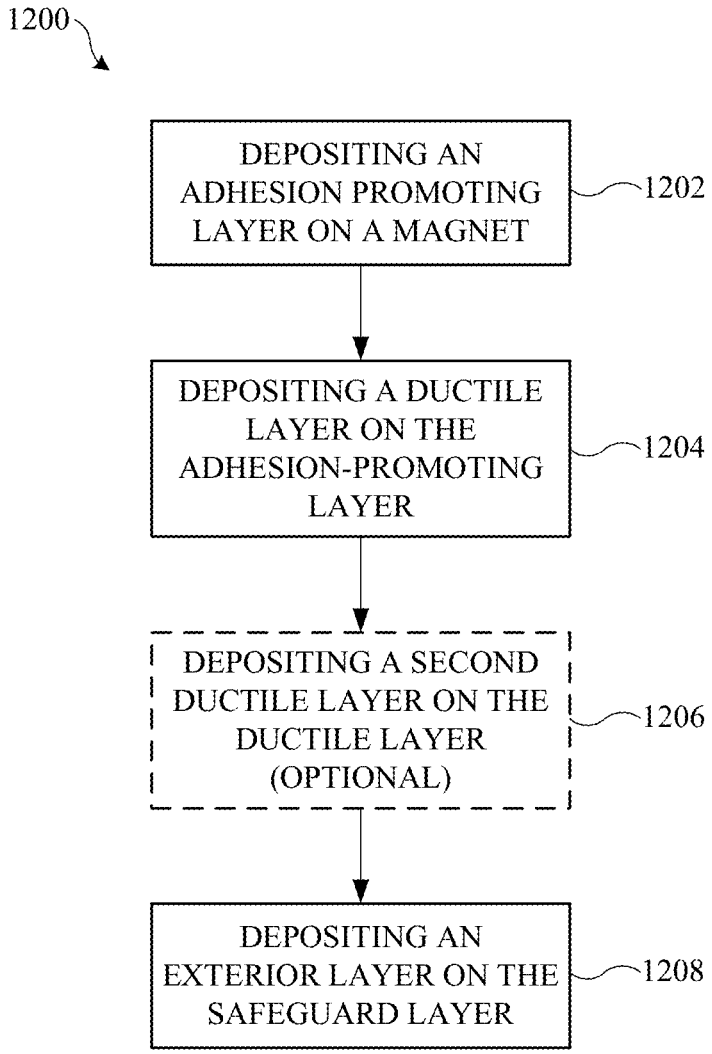
FIG. 12 shows a flowchart indicating a process for forming a multilayered coating on a magnet in accordance with some embodiments.

FIG. 12 illustrates flowchart 1200 that indicates a process for forming a multilayered coating on a magnet in accordance with some embodiments. At 1202, an adhesion-promoting layer is plated on a surface of the magnet. The adhesion-promoting layer is configured to adhere well to a surface of the magnet so as to create a strong foundation for the multilayered coating. In some embodiments, portions of the adhesion-promoting layer infuse within intergranular cracks of the magnet, thereby creating good adhesive contact with the magnet and also supporting the microstructure of the magnetic material of the magnet. In some embodiments, nickel was found to provide preferred adhesion characteristics. In other embodiments, zinc or palladium were found to act as a good material for adhesion-promoting layer. In some embodiments, the adhesion-promoting layer includes alloys, such as alloys of two or more of nickel, zinc and palladium. In some embodiments, the adhesion-promoting layer includes sub-layers of metals. The adhesion-promoting layer can be plated on using standard plating techniques or electroless plating.

At 1204, a ductile layer is deposited on the adhesion-promoting layer. The ductile layer can serve to relieve tensile stresses within the multilayered stack up. For example, intergranular cracks within the magnet can cause stresses to build up within the multilayered coating. The ductile layer should be made of a ductile material, such as copper, that can absorb these stresses and prevent breakage of the multilayered coating. The ductile layer can be thicker than the adhesion-promoting layer. In some embodiments, the ductile layer also serves as the adhesion-promoting layer. For example, in a particular embodiment, a single copper layer serves as both the adhesion-promoting layer and ductile layer. In another embodiment, a first layer of copper deposited using alkaline plating serves as an adhesion-promoting layer and a second layer of copper deposited using acidic plating serves as a ductile layer.

At 1206, an optional second ductile layer is deposited on the ductile layer. The second ductile layer can serve to prevent damage to the multilayered coating in case a subsequently deposited exterior layer is breached or to further attenuate stresses. The second ductile layer is generally very thin and made of a corrosion resistant material. In some embodiments, the second ductile layer includes one or more of zinc, nickel, palladium, and alloys thereof. Note that in some embodiments a separate second ductile layer may not be necessary if the subsequently deposited exterior layer is sufficiently resistant to breaking, such as by annealing or reinforcement.

At 1208, the exterior layer is deposited on the second ductile layer, if used, or on the ductile layer if the second ductile layer is not used. The exterior layer has an exterior surface that corresponds to the exterior surface of the multilayered coating. Thus, the exterior layer can serve as a last barrier to prevent release of nickel and/or cobalt from the multilayered material. In addition, the exterior layer can be subjected to abrasion from external scratching forces, thus should be scratch resistant. In some embodiments, the exterior layer is corrosion resistant so as to maintain structural integrity when exposed to moisture. In some embodiments, the exterior layer does not include nickel and/or cobalt. For example, a tin and copper alloy layer has been found to provide good protection. In some embodiments, the tin and copper alloy is annealed to increase the tensile strength of the tin and copper alloy layer. In some embodiments, the exterior layer includes a reinforcement sub-layer, such as a gold, rhodium, ruthenium, rhodium and ruthenium alloy, palladium, or gold and palladium alloy. In other embodiments, the exterior layer can be an electrolessly deposited layer of nickel that is resistant to nickel release. In some embodiments the electrolessly deposited nickel layer has a high phosphorus content (high-P EN). In some cases, the exterior layer also includes a polymer layer, such as a layer of epoxy or a poly(p-xylylene) polymer layer.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

The invention claimed is:

1. A multilayered coating for a magnet, the multilayered coating comprising:

a first layer disposed on the magnet;

a second layer disposed on the first layer and characterized as having a first ductility;

a third layer disposed on the second layer and characterized as having a second ductility less than the first ductility; and a layer that is substantially free of nickel and cobalt disposed on the third layer and having an exposed surface corresponding to an exterior surface of the multilayered coating, wherein the layer that is substantially free of nickel and cobalt comprises a tin and copper alloy and has a thickness of about 7 micrometers or greater.

2. The multilayered coating of claim 1, wherein the layer that is substantially free of nickel and cobalt has a thickness that is greater than a thickness of the second layer.

3. The multilayered coating of claim 1, wherein the third layer is substantially free of nickel.

4. The multilayered coating of claim 1, wherein the first layer comprises at least one of zinc, palladium, cobalt, nickel, or copper.

5. The multilayered coating of claim 1, wherein the layer that is substantially free of nickel and cobalt comprises a polymer.

6. The multilayered coating of claim 5, wherein the polymer includes poly(p-xylylene) or epoxy.

7. The multilayered coating of claim 1, wherein the second layer comprises zinc.

8. The multilayered coating of claim 1, wherein the third layer comprises at least one of zinc, palladium or cobalt.

9. The multilayered coating of claim 1, wherein the first layer is electrolessly plated on the magnet.

10. The multilayered coating of claim 1, wherein the first layer includes a nickel sub-layer and a palladium and nickel alloy sub-layer.

11. A method of forming a multilayered coating on a magnet, the method comprising:

plating a first layer on a surface of the magnet;

plating a second layer on the first layer, the second layer characterized as having a first ductility;

plating a third layer on the second layer, the third layer characterized as having a second ductility less than the first ductility; and depositing a layer that is substantially free of nickel and cobalt on the third layer such that the layer that is substantially free of nickel and cobalt has an exposed surface corresponding to an exterior surface of the multilayered coating, wherein the layer that is substantially free of nickel and cobalt comprises a tin and copper alloy and has a thickness of about 7 micrometers or greater.

12. The method of claim 11, further comprising:

annealing the multilayered coating on the magnet.

13. The method of claim 11, wherein the first layer includes nickel, and wherein plating the first layer on the surface of the magnet comprises electrolessly plating the first layer on the surface of the magnet.

14. The method of claim 11, wherein the third layer includes nickel, and wherein plating the third layer comprises electrolessly plating the third layer on the second layer.

15. A magnet having a multilayered coating, the multilayered coating comprising:

a first layer disposed on the magnet and comprising at least one of nickel, zinc, palladium, cobalt or copper;

a second layer disposed on the first layer and comprising at least one of copper or zinc;

a third layer disposed on the second layer and comprising at least one of zinc, palladium or cobalt; and a layer that is substantially free of nickel disposed on the third layer and comprising at least one of a tin and copper alloy, aluminum, manganese, palladium, rhodium, ruthenium, gold, zinc, or a polymer, wherein the layer that is substantially free of nickel has a thickness that is about 7 micrometers or greater.

16. The magnet of claim 15, wherein the layer that is substantially free of nickel has a thickness that is greater than a thickness of the second layer.

17. The magnet of claim 15, wherein the first layer includes a nickel sub-layer and a palladium and nickel alloy sub-layer.

18. The magnet of claim 15, wherein the layer that is substantially free of nickel is substantially free of cobalt.

19. The magnet of claim 15, wherein the layer that is substantially free of nickel comprises a polymer, wherein the polymer includes poly(p-xylylene) or epoxy.

20. The magnet of claim 15, wherein the layer that is substantially free of nickel comprises at least one of an aluminum and manganese alloy or a gold and palladium alloy.

* * * * *